US010191430B2

(12) United States Patent
Sakaguchi et al.

(10) Patent No.: US 10,191,430 B2
(45) Date of Patent: Jan. 29, 2019

(54) IMAGE FORMING APPARATUS

(71) Applicant: CANON KABUSHIKI KAISHA, Tokyo (JP)

(72) Inventors: Ryou Sakaguchi, Toride (JP); Toshifumi Oikawa, Tsukubamirai (JP); Hiroyuki Eda, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/948,213

(22) Filed: Apr. 9, 2018

(65) Prior Publication Data

US 2018/0299816 A1 Oct. 18, 2018

(30) Foreign Application Priority Data

Apr. 17, 2017 (JP) ..... 2017-081520

(51) Int. Cl.
*G03G 15/00* (2006.01)
*G03G 21/16* (2006.01)
*G03G 15/08* (2006.01)

(52) U.S. Cl.
CPC ..... *G03G 15/556* (2013.01); *G03G 15/0856* (2013.01); *G03G 15/0872* (2013.01); *G03G 21/1633* (2013.01); *G03G 2221/163* (2013.01)

(58) Field of Classification Search
CPC ..... G03G 15/0856; G03G 15/0872; G03G 15/556; G03G 21/1633; G03G 2221/163
See application file for complete search history.

(56) References Cited

U.S. PATENT DOCUMENTS 7,228,078 B2 * 6/2007 Okochi ..... G03G 15/553 399/13
8,437,648 B2 * 5/2013 Tachibana ..... G03G 15/553 399/13
2006/0045546 A1 3/2006 Okochi

* cited by examiner

*Primary Examiner* — Hoang Ngo
(74) *Attorney, Agent, or Firm* — Canon U.S.A., Inc. IP Division

(57) ABSTRACT

An image forming apparatus includes an image forming unit, mounting unit to which a container is mounted, cover, detector, controller, and display unit. The image forming unit forms an image by using a developer, the cover is opened/closed to replace/cover the mounted container, the detector detects the mounted container in a cover closed/opened state, the controller determines whether a remaining amount of the developer in the container is more than a predetermined amount, and the display unit displays, in a case where the container in which the remaining amount is more than the predetermined amount is removed, a first screen promoting re-mounting of the container, a second screen on closing the cover without detecting the container after displaying the first screen, and a third screen after displaying the second screen in a case where the container is not mounted.

15 Claims, 12 Drawing Sheets

FIG. 10A

△TONER BOTTLE OF THE FOLLOWING COLOR THAT IS STILL USABLE HAS BEEN REMOVED.

· YELLOW

PLEASE SET REMOVED TONER BOTTLE AGAIN.
WE KINDLY ASK FOR YOUR COOPERATION FOR EFFECTIVE USE OF LIMITED RESOURCES.

FIG. 10B

△THE FOLLOWING TONER BOTTLE IN WHICH TONER STILL REMAINS HAS BEEN REMOVED.
PLEASE CARRY OUT RECOVERY OPERATION.

· YELLOW

RECOVERY OPERATION:
PLEASE REMOVE TONER BOTTLE OF THE COLOR AND THEN SET AGAIN TONER BOTTLE ORIGINALLY SET BEFORE REPLACEMENT.

FIG. 10C

△TONER BOTTLE HAS NOT BEEN SET.
PLEASE SET TONER BOTTLE.

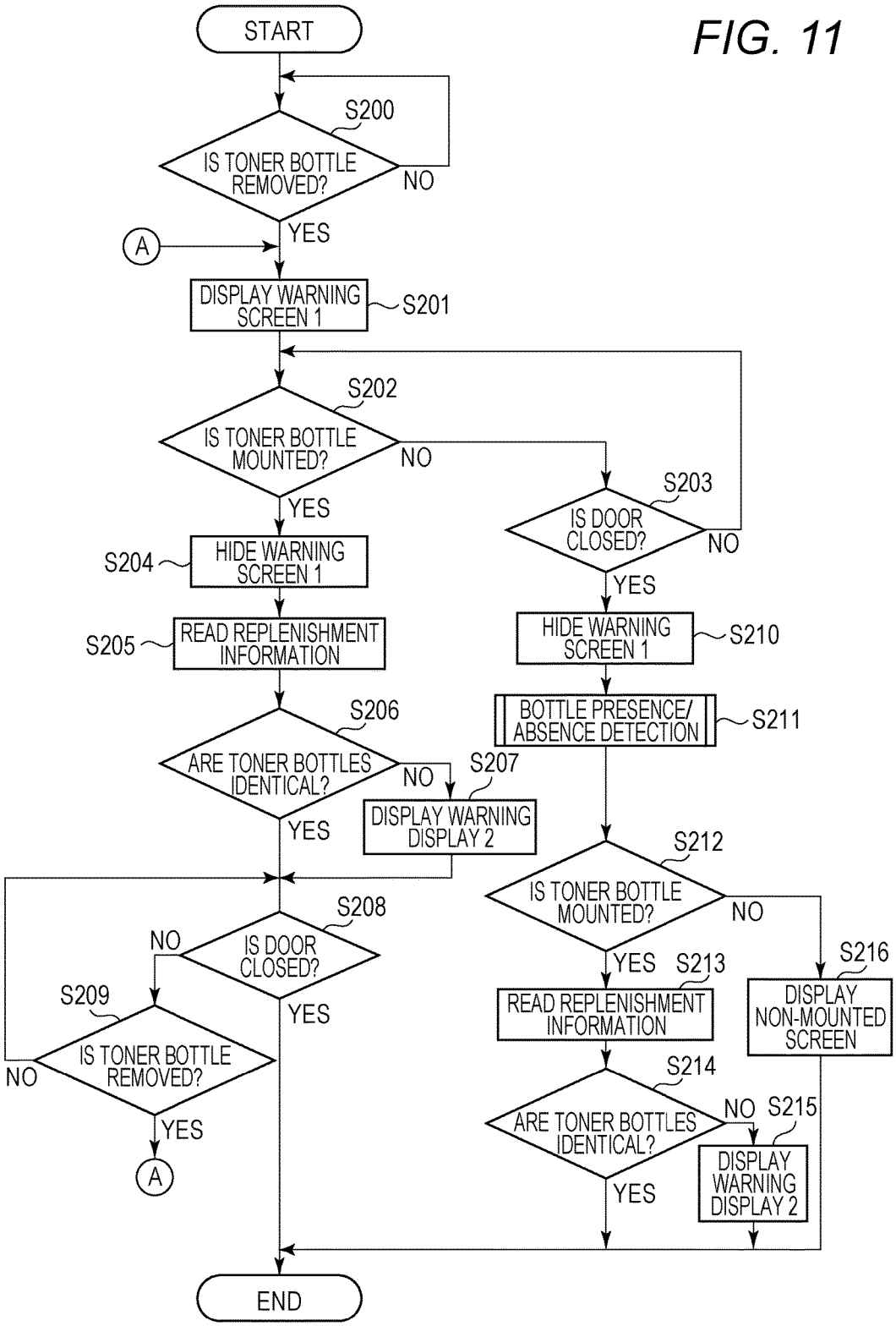
FIG. 11
START
S200
IS TONER BOTTLE REMOVED?
NO
YES
A
DISPLAY WARNING SCREEN 1
S201
S202
IS TONER BOTTLE MOUNTED?
NO
YES
S203
IS DOOR CLOSED?
NO
YES
S204
HIDE WARNING SCREEN 1
S205
READ REPLENISHMENT INFORMATION
S206
ARE TONER BOTTLES IDENTICAL?
NO
YES
S207
DISPLAY WARNING DISPLAY 2
S208
IS DOOR CLOSED?
NO
YES
S209
IS TONER BOTTLE REMOVED?
NO
YES
A
S210
HIDE WARNING SCREEN 1
S211
BOTTLE PRESENCE/ ABSENCE DETECTION
S212
IS TONER BOTTLE MOUNTED?
NO
YES
S213
READ REPLENISHMENT INFORMATION
S214
ARE TONER BOTTLES IDENTICAL?
NO
YES
S215
DISPLAY WARNING DISPLAY 2
S216
DISPLAY NON-MOUNTED SCREEN
END

IMAGE FORMING APPARATUS

BACKGROUND

Field of the Disclosure

The present invention relates to an image forming apparatus to which a container for containing developer is attachable.

Description of the Related Art

In an image forming apparatus of an electrophotographic system, an electrostatic latent image formed on the surface of a photosensitive member is developed with developer contained in a developing device, to thereby form an image. Only a limited amount of developer can be contained in the developing device. Accordingly, the developing device is filled as needed with developer from the container that is attachable to the image forming apparatus.

The amount of developer to be filled in the developing device from the container varies depending on the rotation state of the container. Therefore, an image forming apparatus that controls rotational driving of a container based on a result of detecting a rotation amount of the container is considered.

Further, since the amount of developer to be contained in the container is limited, if the developer contained in the container is used up, it is impossible to fill the developing device with toner from the container. Therefore, if there is no developer left in the container, the image forming apparatus notifies a user of the need for replacing the container.

However, even when the amount of developer contained in the container is equal to or more than a predetermined amount, the user may replace the container. Accordingly, an image forming apparatus disclosed in US 2006/0045546 displays a screen for issuing a warning that developer remains in a container when the container is removed before the developer contained in the container is used up. According to the image forming apparatus disclosed in US 2006/0045546, the user is notified that the container is still usable, so that the user is prevented from replacing the container in which developer is left.

SUMMARY

According to an aspect of the present invention, an image forming apparatus includes an image forming unit configured to form an image by using a developer; a mounting unit to which a container is mounted, wherein the container is configured to contain a developer, and wherein the container supplies the developer to the image forming unit; a cover configured to be opened to replace the container mounted to the mounting unit, and to be closed to cover the container mounted to the mounting unit; a detector configured to detect the container mounted to the mounting unit, the detector being capable of detecting the container mounted to the mounting unit in a state where the cover is closed or in a state where the cover is opened; a controller configured to determine whether a remaining amount of the developer contained in the container mounted to the mounting unit is more than a predetermined amount; and a display unit configured to display, in a case where the container in which the remaining amount of developer is more than the predetermined amount is removed from the mounting unit, a first screen to prompt re-mounting of the removed container, display a second screen different from the first screen in a case where the cover is closed without detecting the container by the detector after the first screen is displayed, and display a third screen different from the second screen after the second screen is displayed in a case where the container is not mounted to the mounting unit.

Further features of the present invention will become apparent from the following description of exemplary embodiments (with reference to the attached drawings).

BRIEF DESCRIPTION OF THE DRAWINGS

FIG. 10A is a schematic diagram illustrating a warning screen 1.

FIG. 10B is a schematic diagram illustrating a warning screen 2.

FIG. 10C is a schematic diagram illustrating a non-mounted screen.

FIG. 11 is a flowchart illustrating display control of a liquid crystal screen.

DESCRIPTION OF THE EMBODIMENTS (Description of Image Forming Apparatus)

Figure 1:
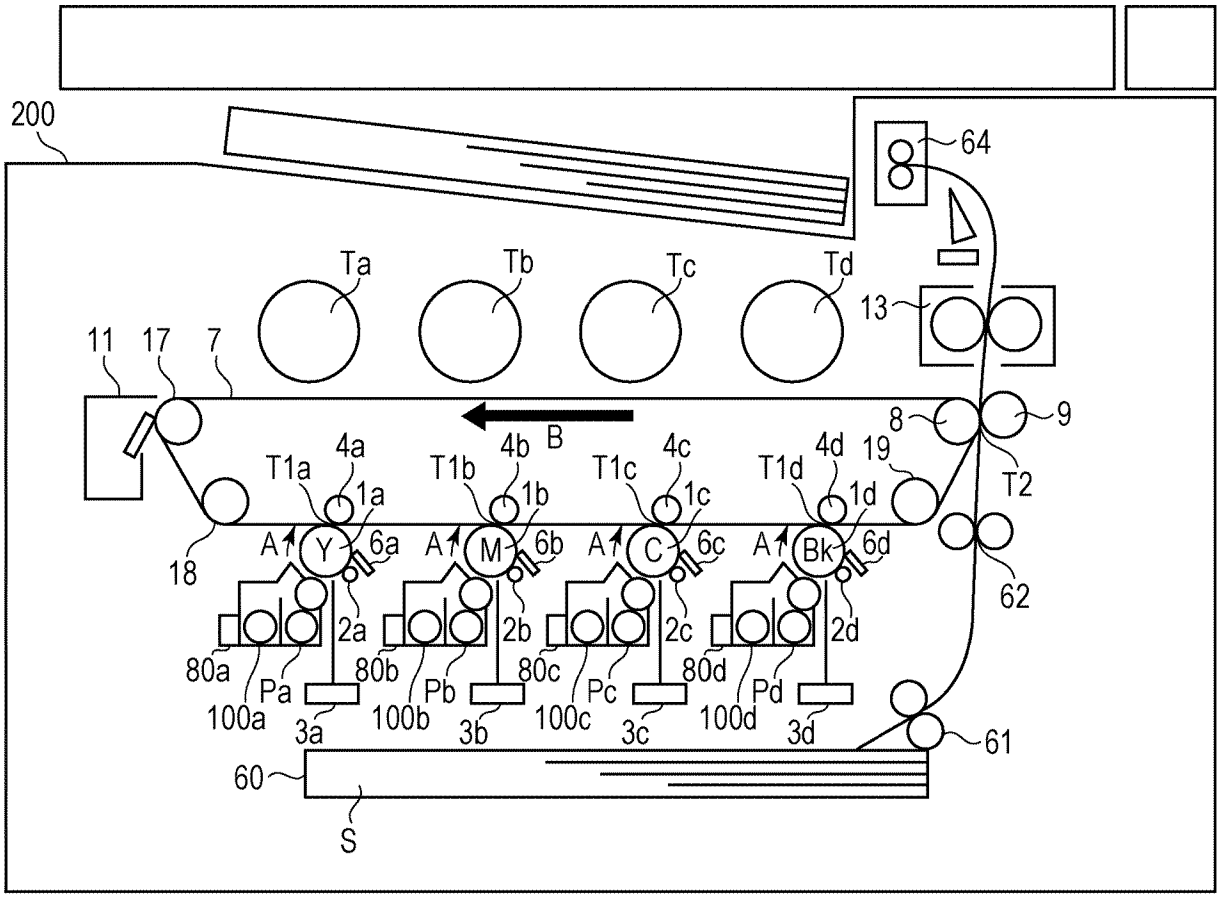
FIG. 1 is a schematic sectional view of an image forming apparatus.

FIG. 1 is a schematic sectional view of an image forming apparatus 200. The image forming apparatus 200 has a configuration in which four image forming units Pa, Pb, Pc, and Pd which form toner images of respective color components are arranged side by side in a conveyance direction of an intermediate transfer belt 7. The image forming unit Pa forms a yellow toner image. The image forming unit Pb forms a magenta toner image. The image forming unit Pc forms a cyan toner image. The image forming unit Pd forms a black toner image.

Toner bottles Ta, Tb, and Tc, and Td which are attachable to the image forming apparatus 200 are mounted to the image forming apparatus 200. The toner bottle Ta contains yellow toner. The toner bottle Tb contains magenta toner. The toner bottle Tc contains cyan toner. The toner bottle Td contain black toner. The toner bottles Ta, Tb, and Tc, and Td correspond to containers for containing toner.

The image forming units Pa, Pb, Pc, and Pd have the same configuration. Accordingly, the image forming unit Pa that forms a yellow toner image is described below, and descriptions of the configurations of the other image forming units Pb, Pc, and Pd are omitted.

The image forming unit Pa includes a photosensitive drum 1*a* including a photosensitive layer that is formed on the surface of a metallic roller and functions as a photosensitive member, a charger 2*a* that charges the photosensitive drum 1*a*, and a developing device 100*a* that contains developer (toner). A direction indicated by an arrow A is a direction in which the photosensitive drum 1*a* rotates. After the photosensitive drum 1*a* is charged by the charger 2*a*, a laser exposure device 3*a* exposes the photosensitive drum 1*a* to light based on yellow color component image data. As a result, an electrostatic latent image corresponding to the yellow color component is formed on the surface of the photosensitive drum 1*a*. The developing device 100*a* develops the electrostatic latent image formed on the surface of the photosensitive drum 1*a* by using toner. As a result, a toner image is formed on the surface of the photosensitive drum 1*a*. The developing device 100*a* includes a toner density sensor 80*a* that detects the amount of developer (toner) contained in the developing device 100*a*. When the toner density sensor 80*a* detects a decrease in the amount of toner contained in the developing device 100*a*, toner is supplied to the developing device 100*a* from the toner bottle Ta.

The image forming unit Pa includes a primary transfer roller 4*a* that transfers the toner image formed on the surface of the photosensitive drum 1*a* onto the intermediate transfer belt 7. While the toner image formed on the surface of the photosensitive drum 1*a* passes through a primary transfer nip portion T1*a* where the photosensitive drum 1*a* and the intermediate transfer belt 7 are pressed against the primary transfer roller 4*a*, a primary transfer voltage is applied to the primary transfer roller 4*a*. As a result, the toner image formed on the surface of the photosensitive drum 1*a* is transferred onto the intermediate transfer belt 7. The image forming unit Pa also includes a drum cleaner 6*a* that removes residual toner on the photosensitive drum 1*a*.

The intermediate transfer belt 7 is hung around a secondary-transfer counter roller 8, a driven roller 17, a first tension roller 18, and a second tension roller 19. The intermediate transfer belt 7 is rotationally driven by the secondary-transfer counter roller 8 and rotates in a direction indicated by an arrow B. In other words, the toner image formed on the surface of the intermediate transfer belt 7 is conveyed in the direction indicated by the arrow B.

A secondary transfer roller 9 is disposed on the opposite side of the secondary-transfer counter roller 8 with respect to the intermediate transfer belt 7. An application of a secondary-transfer voltage to the secondary-transfer counter roller 8 allows the toner image formed on the surface of the intermediate transfer belt 7 to be transferred onto a sheet S in a secondary-transfer nip portion T2 where the secondary-transfer counter roller 8 and the intermediate transfer belt 7 are pressed against the secondary transfer roller 9. A belt cleaner 11 removes residual toner on the intermediate transfer belt 7.

The sheet S having the toner image transferred thereto is stored in a cassette unit 60. A sheet feed roller (not illustrated) feeds the sheet S contained in the cassette unit 60. A conveyance roller 61 conveys the sheet S fed by the sheet feed roller (not illustrated) toward a registration roller 62. After the sheet S is conveyed to the registration roller 62, the registration roller 62 conveys the sheet S in such a manner that the sheet S contacts the toner image formed on the surface of the intermediate transfer belt 7.

After the toner image is transferred onto the sheet S by the secondary transfer roller 9, the sheet S is conveyed to a fixing unit 13. The fixing unit 13 includes a fixing roller including a heater, and a pressure roller, and fixes the toner image formed on the sheet S onto the sheet S by the heat from the heater and pressure of each of the fixing roller and the pressure roller. The sheet S onto which the toner image is fixed by the fixing unit 13 is discharged from the image forming apparatus 200 by the discharge roller 64.

Next, an image forming operation in which the image forming apparatus 200 according to the present exemplary embodiment prints a printed matter based on the image data transferred from a personal computer (PC), a scanner, or the like which is not illustrated will be described.

The photosensitive drums 1*a*, 1*b*, 1*c*, and 1*d* start rotational driving in the direction indicated by the arrow A. The chargers 2*a*, 2*b*, 2*c*, and 2*d* uniformly charge the photosensitive drums 1*a*, 1*b*, 1*c*, and 1*d*, respectively. The laser exposure devices 3*a*, 3*b*, 3*c*, and 3*d* respectively expose the photosensitive drums 1*a*, 1*b*, 1*c*, and 1*d* to light based on image data. As a result, electrostatic latent images corresponding to the color components of the image data are formed on the photosensitive drums 1*a*, 1*b*, 1*c*, and 1*d*, respectively. At this time, the sheet feed roller (not illustrated) feeds the sheet S stored in the cassette unit 60 and the conveyance roller 61 starts conveying the sheet S toward the registration roller 62.

Next, the developing devices 100*a*, 100*b*, 100*c*, and 100*d* develop the electrostatic latent images formed on the surfaces of the photosensitive drums 1*a*, 1*b*, 1*c*, and 1*d*, respectively, thereby forming toner images of color components on the surfaces of the photosensitive drums 1*a*, 1*b*, 1*c*, and 1*d*, respectively. The toner images formed on the surfaces of the photosensitive drums 1*a*, 1*b*, 1*c*, and 1*d* are conveyed to the primary transfer nip portions T1*a*, T1*b*, T1*c*, and T1*d*, respectively, according to the rotation of the photosensitive drums 1*a*, 1*b*, 1*c*, and 1*d* in the direction indicated by the arrow A. In the primary transfer nip portions T1*a*, T1*b*, T1*c*, and T1*d*, the toner images of the color components formed on the photosensitive drums 1*a*, 1*b*, 1*c*, and 1*d*, respectively, are transferred onto the intermediate transfer belt 7. The primary transfer rollers 4*a*, 4*b*, 4*c*, and 4*d* transfer the toner images formed on the photosensitive drums 1*a*, 1*b*, 1*c*, and 1*d*, respectively, onto the intermediate transfer belt 7. As a result, a full-color toner image is formed on the intermediate transfer belt 7. Residual toner on the photosensitive drums 1*a*, 1*b*, 1*c*, and 1*d* is removed by the drum cleaners 6*a*, 6*b*, 6*c*, and 6*d*, respectively.

The registration roller 62 adjusts the timing of conveying the sheet S to the secondary-transfer nip portion T2 in such a manner that the toner image formed on the intermediate transfer belt 7 is transferred onto a desired position on the sheet S. In the secondary-transfer nip portion T2, the secondary transfer roller 9 transfers the toner image formed on the intermediate transfer belt 7 onto the sheet S. In the secondary-transfer nip portion T2, residual toner on the intermediate transfer belt 7 that is not transferred onto the sheet S is removed by the belt cleaner 11.

The sheet S bearing the toner image is conveyed to the fixing unit 13. Then, the fixing unit 13 melts and fixes an unfixed toner image on the sheet S onto the sheet S. The sheet S which has passed through the fixing unit 13 is discharged from the image forming apparatus 200 by the discharge roller 64. The image forming apparatus 200 can print a printed matter based on image data by the image forming operation described above.

(Control Block Diagram of Image Forming Apparatus)

Figure 2:
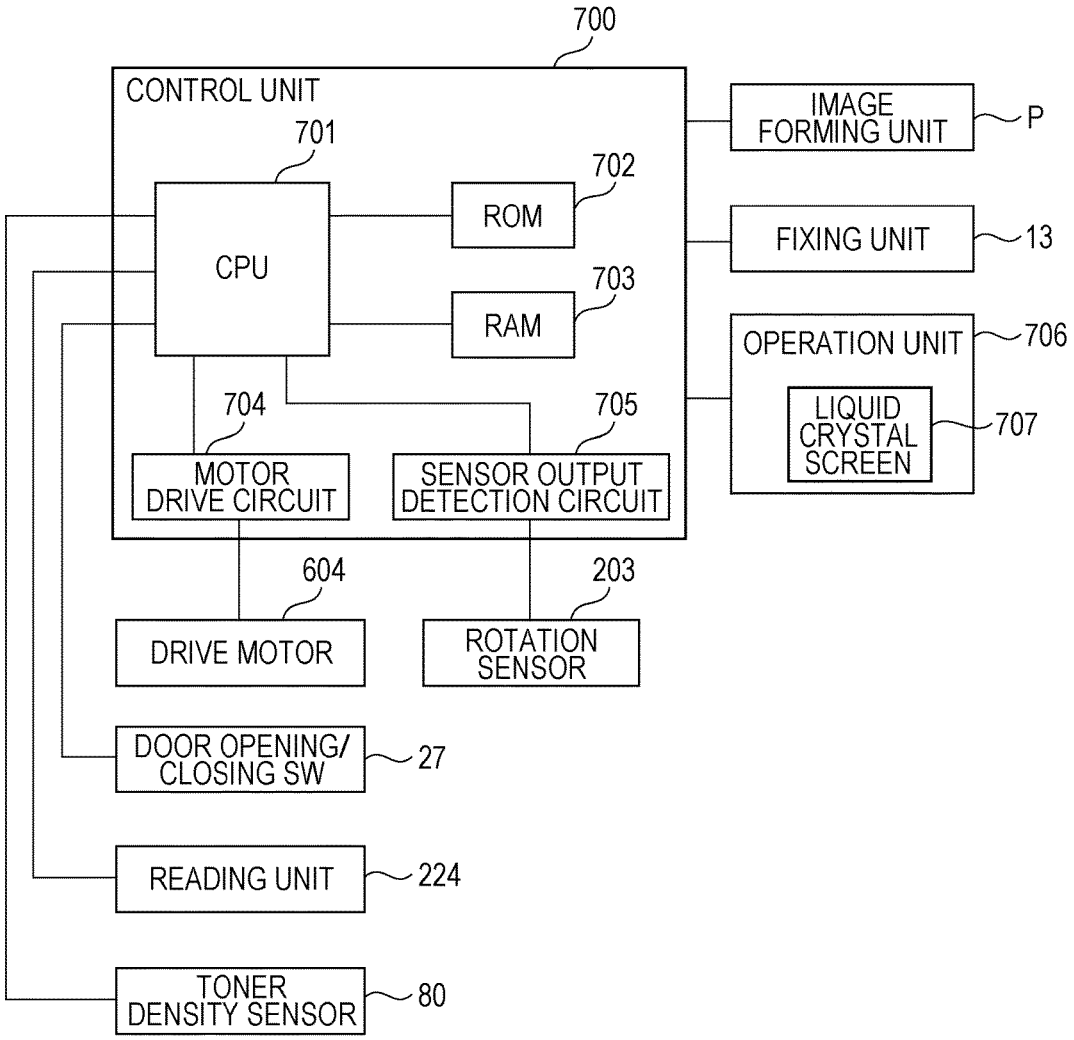
FIG. 2 is a control block diagram of the image forming apparatus.

FIG. 2 is a control block diagram illustrating the image forming apparatus 200 according to the present exemplary embodiment. In the following description, the toner bottles Ta, Tb, and Tc, and Td are collectively referred to as a toner bottle T, and the developing devices 100*a*, 100*b*, 100*c*, and 100*d* are collectively referred to as a developing device 100. Similarly, the image forming units Pa, Pb, Pc, and Pd are collectively referred to as an image forming unit P, and the toner density sensors 80*a*, 80*b*, 80*c*, and 80*d* are collectively referred to as a toner density sensor 80.

A control unit 700 controls entire image forming apparatus 200. The control unit 700 includes a central processing unit (CPU) 701, a read-only memory (ROM) 702, a random access memory (RAM) 703, a motor drive circuit 704, and a sensor output detection circuit 705.

The CPU 701 is a control circuit that controls each device of the image forming apparatus 200. The ROM 702 stores control programs for controlling various processes to be executed by the image forming apparatus 200. The RAM 703 is a system work memory that is used for the CPU 701 to execute the control programs. The image forming unit P and the fixing unit 13 have been described above with reference to FIG. 1, and thus the descriptions thereof are herein omitted.

The toner density sensor 80 outputs, for example, a signal corresponding to a magnetic permeability that changes based on the amount of toner contained in the developing device 100. The toner density sensor 80 is not limited to the sensor that outputs the signal corresponding to the magnetic permeability that changes based on the amount of toner contained in the developing device 100. Any sensor may be used as the toner density sensor 80, as long as the sensor can detect the amount of toner contained in the developing device 100. The CPU 701 converts the output signal from the toner density sensor 80 into a toner density based on a conversion table which is not illustrated. The CPU 701 controls the replenishment of toner from the toner bottle T to the developing device 100 in such a manner that the toner density becomes a target density.

The operation unit 706 includes a liquid crystal screen 707. The liquid crystal screen 707 is a touch panel. The operation unit 706 functions as a display unit including the touch panel. The liquid crystal screen 707 of the operation unit 706 displays a warning screen or a non-mounted screen according to a signal from the CPU 701. Further, the liquid crystal screen 707 notifies the user of the state of the image forming apparatus 200 according to a signal from the CPU 701. The configuration for displaying the screen described above is not limited to the liquid crystal screen 707, but instead, for example, a monitor of a PC that is communicably connected to the image forming apparatus 200 via a network may be used.

A drive motor 604 is a drive source that causes the toner bottle T to rotate so that toner is filled in the developing device 100 from the toner bottle T. The motor drive circuit 704 controls a current to be supplied to the drive motor 604 so as to control the drive motor 604. The CPU 701 sets a PWM value as a control value indicating the ratio of time during which the current is supplied to the drive motor 604 per predetermined time. Thus, the motor drive circuit 704 controls the current to be supplied to the drive motor 604 based on the PWM value. In the present exemplary embodiment, a DC motor (DC brush motor) is used as the drive motor 604. Accordingly, the rotation speed of the drive motor 604 and the rotational driving force of the drive motor 604 are changed depending on the ratio of the time during which the current is supplied to the drive motor 604 per predetermined time.

While the CPU 701 is outputting an ENB signal, the motor drive circuit 704 can supply current to the drive motor 604. In other words, while the CPU 701 is outputting the ENB signal, the motor drive circuit 704 supplies the current based on the PWM value of the drive motor 604. Thus, the toner bottle T is rotationally driven. On the other hand, when the CPU 701 stops supplying the ENB signal, the motor drive circuit 704 stops supplying the current to the drive motor 604. As a result, the rotation of the toner bottle T is stopped.

The rotation sensor 203 is an optical sensor including a light emitting unit and a light receiving unit, and outputs a signal corresponding to the amount of light received by the light receiving unit. While a predetermined region of the toner bottle T is passing through a detection position, the amount of light received by the rotation sensor 203 is equal to or more than a threshold. On the other hand, while a region other than the predetermined region of the toner bottle T is passing through the detection position in the rotation direction in which the toner bottle T is rotated, the amount of light received by the rotation sensor 203 is less than the threshold. A specific configuration of the rotation sensor 203 is described below with reference to FIGS. 6A and 6B.

On the basis of the output signal from the rotation sensor 203, the sensor output detection circuit 705 outputs a low-level signal when the amount of light received by the rotation sensor 203 is equal to or more than the threshold, and the sensor output detection circuit 705 outputs a high-level signal when the amount of light received by the rotation sensor 203 is less than the threshold. In other words, the sensor output detection circuit 705 outputs the low-level signal while the predetermined region of the toner bottle T is passing through the detection position, and outputs the high-level signal while the region other than the predetermined region of the toner bottle T is passing through the detection position.

The reading unit 224 reads replenishment information recorded on a memory 223 (FIGS. 5A to 5C) of the toner bottle T mounted to the mounting position of the image forming apparatus 200 and notifies the CPU 701 of the read replenishment information. Further, the reading unit 224 may write the replenishment information notified from the CPU 701 into the memory 223 (FIGS. 5A to 5C) of the toner bottle T.

Figure 5A:
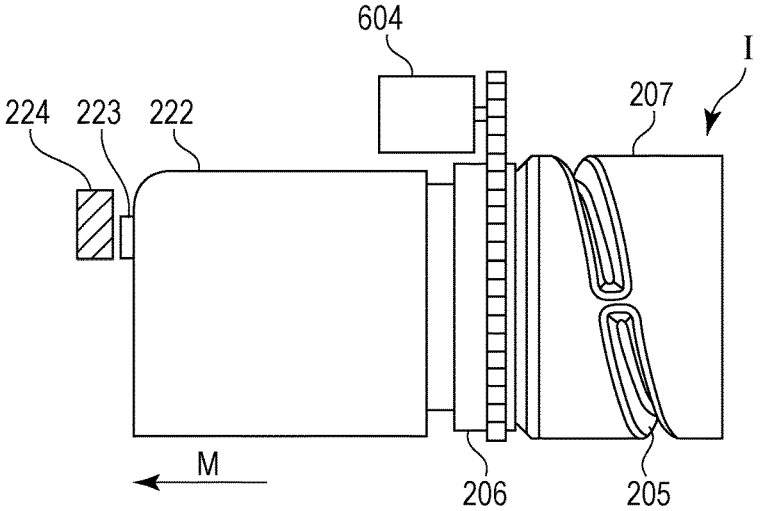
FIGS. 5A, 5B, and 5C are schematic diagrams each illustrating a main part of a toner bottle.
Figure 5B:
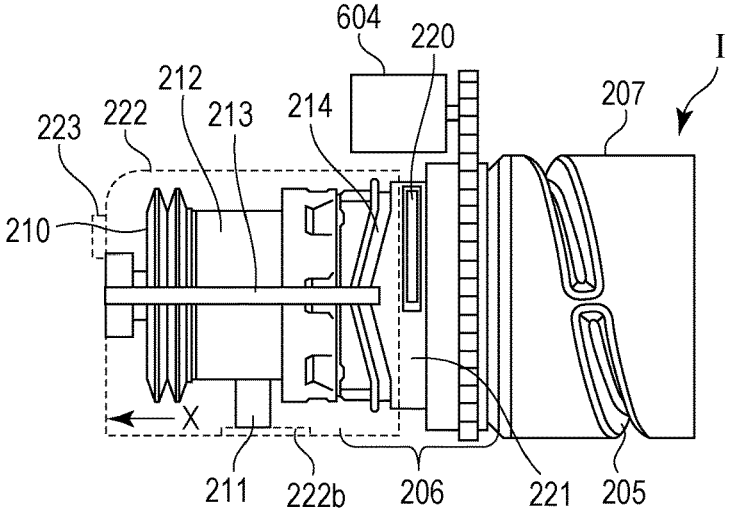
Figure 5C:
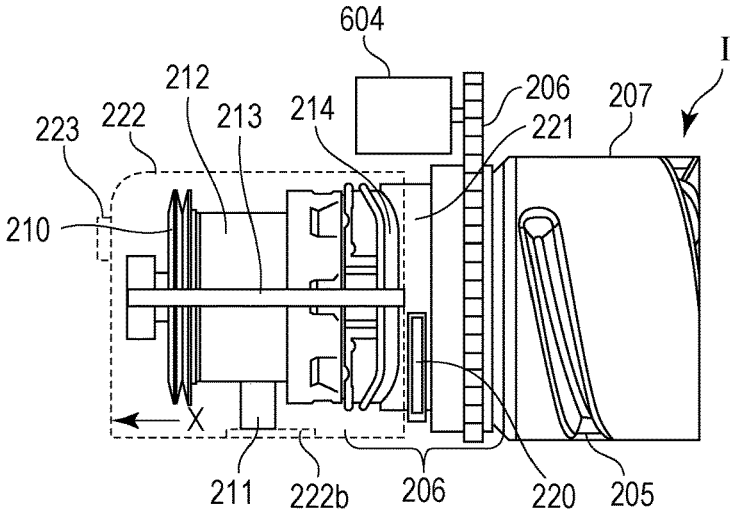

The replenishment information described above includes, for example, the color of toner contained in the toner bottle T, the identification number of the toner bottle T, and the replenishment history of the toner bottle T. The replenishment history of the toner bottle T is, for example, the number of rotations of the toner bottle T. Every time the CPU 701 rotates the toner bottle T once, the reading unit 224 records information about the number of rotations of the toner bottle T on the memory 223 (FIGS. 5A to 5C). The number of rotations of the toner bottle T corresponds to the number of times of replenishment of the toner bottle.

The motor drive circuit 704, the sensor output detection circuit 705, the rotation sensor 203, and the reading unit 224 are provided for each color. The drive motor 604 is also provided for each color. However, the drive motor 604 may have a configuration in which, for example, a plurality of toner bottles T is rotated by one drive motor. If a clutch is configured to be controlled in a state where a driving force can be transmitted from the drive motor 604 to the toner bottle T and in a state where the driving force cannot be transmitted, a plurality of toner bottles T can be selectively rotated by one drive motor 604.

A door opening/closing switch (SW) 27 outputs an opening/closing detection signal to the CPU 701 in accordance with opening/closing of a door 26 (FIG. 3) of the image forming apparatus 200. The opening/closing detection signal is, for example, a binary signal. If the opening/closing detection signal is a low-level signal, the CPU 701 determines that the door 26 (FIG. 3) is in the closed state. On the other hand, if the opening/closing detection signal is a high-level signal, the CPU 701 determines that the door 26 (FIG. 3) is in the open state. In other words, the CPU 701 detects whether the door 26 (FIG. 3) is in the open state or closed state based on the opening/closing detection signal.

Figure 3:
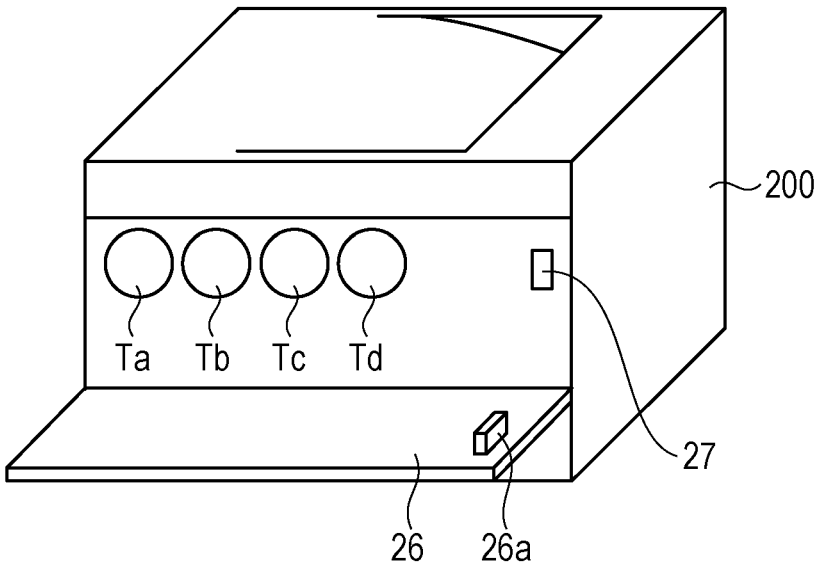
FIG. 3 is a perspective view of the image forming apparatus.

The door 26 of the image forming apparatus 200 will now be described with reference to FIG. 3. FIG. 3 is a perspective view of the image forming apparatus 200 illustrated in FIG. 1. Referring to FIG. 3, the image forming apparatus 200 includes the door 26 that is opened and closed by the user to attach or detach the toner bottle T. The door 26 is provided with a protrusion 26*a*. When the door 26 is closed, the protrusion 26*a* presses the door opening/closing SW 27. When the door opening/closing SW 27 is pressed by the protrusion 26*a*, the door opening/closing SW 27 outputs the low-level signal. On the other hand, when pressing of the protrusion 26*a* is released, the door opening/closing SW 27 outputs the high-level signal. The door 26 may be a door configured in such a manner that only a mounting portion 310 (FIGS. 4A and 4B) to which the toner bottle T is mounted is opened or closed. Alternatively, the door 26 may be a door configured in such a manner that the entirety of one side of the image forming apparatus 200 is opened or closed.

(Description of Mounting Portion)

Figure 4A:
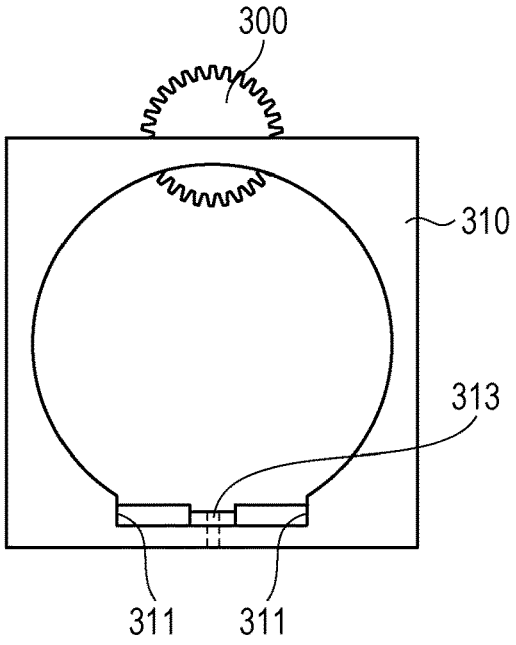
FIG. 4A is a schematic diagram illustrating a main part of a mounting portion.
Figure 4B:
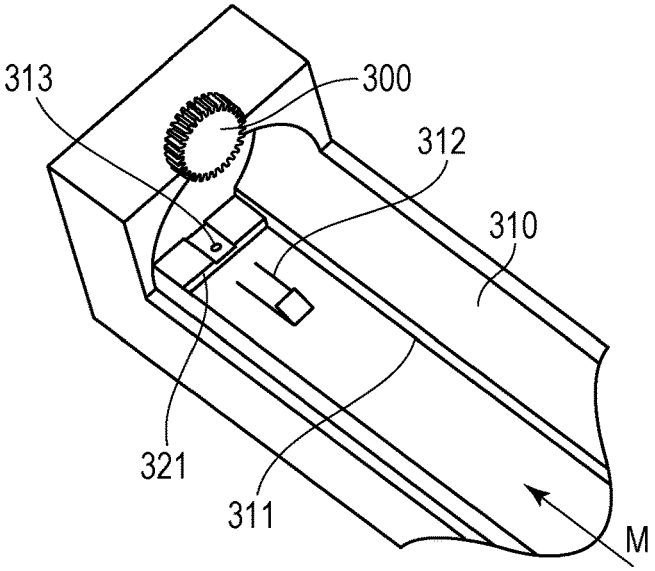
FIG. 4B is a perspective view of the mounting portion.

The configuration of the mounting portion 310 will be described with reference to FIGS. 4A and 4B. FIG. 4A is a partial front view of the mounting portion 310 as viewed from the front side of the toner bottle T in the mounting direction. FIG. 4B is a perspective view illustrating the inside of the mounting portion 310. As illustrated in FIG. 4B, the toner bottle T is mounted to the mounting portion 310 in a direction indicated by an arrow M. The direction indicated by the arrow M is parallel to the rotation axis direction of the photosensitive drums 1*a*, 1*b*, 1*c*, and 1*d* of the image forming apparatus 200. A removal direction of the toner bottle T from the mounting portion 310 is a direction opposite to the direction indicated by the arrow M.

The mounting portion 310 includes a drive gear 300, a rotation regulating unit 311, which regulates the rotation of a cap portion 222 (FIGS. 5A to 5C) of the toner bottle T in accordance with the rotation of the toner bottle T, a bottom portion 321, and a regulating unit 312. The regulating unit 312 engages with the cap portion 222 (FIGS. 5A to 5C) of the toner bottle T, thereby regulating the movement of the cap portion 222 (FIGS. 5A to 5C) in the rotation axis direction.

The drive gear 300 transmits the rotational driving force from the drive motor 604 to the toner bottle T mounted to the mounting portion 310.

The bottom portion 321 is provided with a receiving port (receiving hole) 313 that communicates with a discharge port (discharge hole) 211 (FIGS. 5A to 5C) of the toner bottle T and receives toner discharged from the toner bottle T when the toner bottle T is mounted. The toner discharged from the discharge port 211 (FIGS. 5A to 5C) of the toner bottle T is supplied to the developing device 100 through the receiving port 313. In the present exemplary embodiment, the diameter of the receiving port is the same as the diameter of the discharge port 211 (FIGS. 5A to 5C) and is, for example, about 2 [mm].

(Description of Toner Bottle)

FIG. 5A is a schematic diagram illustrating the main part of the toner bottle T mounted to the mounting portion 310. FIGS. 5B and 5C are main part sectional views each illustrating the structure of the inside of the cap portion 222 of the toner bottle T mounted to the mounting portion 310.

The toner bottle T includes a containing portion 207 that contains toner, a drive transmission portion 206 to which the rotational driving force is transmitted from the drive motor 604, a discharge portion 212 including a discharge port 211 from which toner is discharged, and a pump portion 210 for discharging the toner to the discharge portion 212 from the discharge portion 211. The toner bottle T includes a reciprocating member 213 that expands and contracts the pump portion 210. The drive transmission portion 206 includes a projecting portion 220, a detected portion 221, and a cam groove 214. The cam groove 214 is formed around the drive transmission portion 206 in the rotation direction in which the drive transmission portion 206 of the toner bottle T rotates.

The cam groove 214, the detected portion 221, and the projecting portion 220 which are formed on the drive transmission portion 206 rotate integrally with the drive transmission portion 206. The drive motor 604 transmits the rotational driving force to the drive transmission portion 206 of the toner bottle T through the drive gear 300, thereby rotating each of the drive transmission portion 206 of the toner bottle T and the containing portion 207 that is connected to the drive transmission portion 206. In the containing portion 207, the projecting portion 205 is formed in a spiral manner and the toner contained in the containing portion 207 is conveyed toward the discharge port 211 in accordance with the rotation of the containing portion 207.

Since the rotation of the cap portion 222 is regulated by the mounting portion 310, the cap portion 222 is not rotated even when the drive transmission portion 206 is rotated. The rotation of not only the cap portion 222, but also the rotation of each of the discharge port 211, the pump portion 210, and the reciprocating member 213 is regulated, thereby preventing the discharge port 211, the pump portion 210, and the reciprocating member 213 from being rotated even when the drive transmission portion 206 is rotated.

A rotation regulating groove that regulates the rotation of the reciprocating member 213 in accordance with the rotation of the drive transmission portion 206 is formed in the cap portion 222, and the reciprocating member 213 engages with the rotation regulating groove (FIGS. 5A to 5C). Further, the reciprocating member 213 is connected to the pump portion 210 and a projection portion (not illustrated) engages with the cam groove 214 of the drive transmission portion 206. Accordingly, in accordance with the rotation of the drive transmission portion 206, the reciprocating member 213 moves along the cam groove 214 in a state where the rotation of the reciprocating member 213 is regulated. As a result, the reciprocating member 213 reciprocates in a direction indicated by an arrow X (longitudinal direction of the toner bottle T).

The reciprocating member 213 is connected to the pump portion 210. The reciprocating motion of the reciprocating member 213 allows the pump portion 210 to be repeatedly expanded and compressed. The reciprocating member 213 moves in the direction indicated by the arrow X, thereby allowing the pump portion 210 to be expanded. When the pump portion 210 is expanded, the internal pressure of the toner bottle T decreases and air is sucked from the discharge port 211, thereby loosing the toner contained in the discharge portion 212. Then, the reciprocating member 213 moves in a direction opposite to the direction indicated by the arrow X, thereby allowing the pump portion 210 to be compressed. When the pump portion 210 is compressed, the internal pressure of the toner bottle T increases, thereby allowing the toner accumulated in the discharge port 211 to be supplied to the developing device 100 from the discharge port 211 through a toner conveyance path. In other words, the drive motor 604 functions as a drive source that rotates the toner bottle T mounted to the mounting portion 310 and expands/contracts the pump portion 210 in accordance with rotational driving of the toner bottle T.

The memory 223 on which information about the toner bottle T is recorded is mounted to the cap portion 222. The CPU 701 (FIG. 2) causes the reading unit 224 to communicate with the memory 223 and read the replenishment information of the toner bottle T. The replenishment information includes the identification information of the toner bottle T. For example, the CPU 701 (FIG. 2) executes processing of identifying the toner bottle T based on the identification information stored in the memory 223. Further, the replenishment information includes the value representing the number of rotations of the toner bottle T. The CPU 701 (FIG. 2) updates the information about the number of rotations of the toner bottle T that is stored in the memory 223, every time the toner bottle T is half-turned.

The cap portion 222 includes a seal member 222*b* that seals the discharge port 211. If the seal member 222*b* seals the discharge port 211, leakage of toner contained in the toner bottle T from the discharge port 211 can be prevented. When the user removes the seal member 222*b* before the toner bottle T is mounted to the mounting portion 310 (FIGS. 4A and 4B), the discharge port 211 of the toner bottle T is opened.

FIG. 5B illustrates a state where the pump portion 210 of the toner bottle T is fully expanded, and FIG. 5C illustrates a state where the pump portion 210 of the toner bottle T is fully compressed. The pump portion 210 is a bellows-like pump which is made of resin and in which the volume of the pump portion 210 is variable in accordance with the expanding/contracting operation of the pump portion 210. In other words, the pump portion 210 has a configuration in which "mountain-fold" portions and "valley-fold" portions are alternately arranged along the longitudinal direction of the toner bottle T.

In the present exemplary embodiment, the replenishment operation is carried out twice while the toner bottle T is rotated once. One toner replenishment operation is started from a state where the pump portion 210 is fully compressed, and then the pump portion 210 is expanded and compressed, and the toner replenishment operation is finished in a state where the pump portion 210 is fully compressed.

In the cam groove 214, two peak portions and two valley regions are formed in the order of valley→peak→valley→peak. While the position of the cam groove 214 that engages with the reciprocating member 213 changes from a valley to a peak, the pump portion 210 is fully expanded. While the position of the cam groove 214 that engages with the reciprocating member 213 changes from a peak to a valley, the pump portion 210 is fully compressed. When the cam groove 214 that engages with the reciprocating member 213 is located in the valley, the state where the pump portion 210 is fully compressed is maintained.

(Configuration of Rotation Sensor)

Next, the rotation sensor 203 provided on the image forming apparatus 200 will be described with reference to FIGS. 6A and 6B. The rotation sensor 203 is an optical sensor including a light emitting unit and a light receiving unit that receives light irradiated from the light emitting unit. A flag 204 contacts the drive transmission portion 206 of the toner bottle T by its own weight. Accordingly, the flag 204 is pressed by the projecting portion 220 of the drive transmission portion 206 and thus swings about a rotation axis 204*a* and blocks the light from the light emitting unit. In other words, the rotation sensor 203 can detect whether the flag 204 contacts the projecting portion 220. Similarly, the rotation sensor 203 can detect whether the flag 204 contacts the detected portion 221. That is, the rotation sensor 203 can detect the rotation position (rotation angle) of the toner bottle T.

Figure 6A:
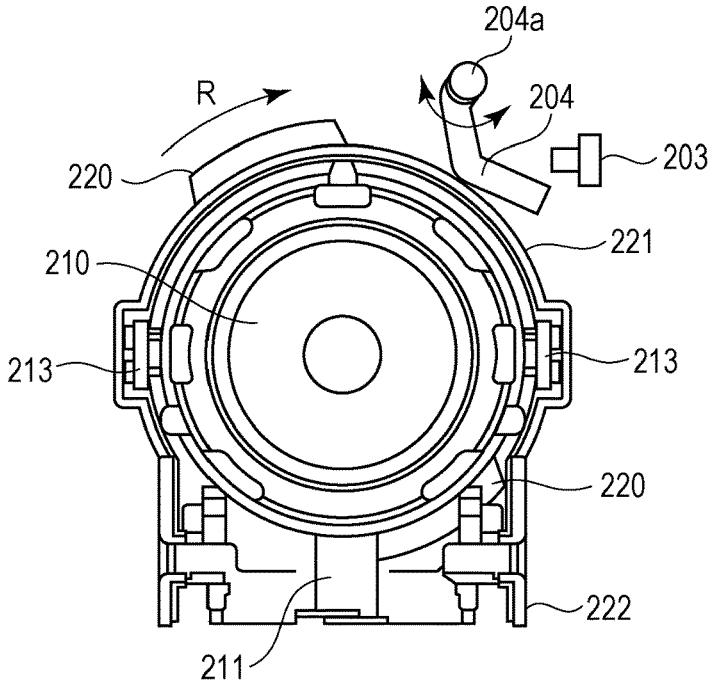
FIGS. 6A and 6B are schematic diagrams illustrating a main part of a rotation sensor.

FIG. 6A illustrates a state where the detected portion 221 contacts the flag 204 in the direction in which the toner bottle T is mounted. The detected portion 221 is a region different from the projecting portion 220 at a position where the detected portion 221 overlaps the region in which the projecting portion 220 is formed and in the rotation direction in which the drive transmission portion 206 rotates. In this case, since the flag 204 is not located between the light emitting unit and the light receiving unit, the light receiving unit can receive the light emitted from the light emitting unit. In the present exemplary embodiment, if the flag 204 is not located between the light emitting unit and the light receiving unit, the amount of light received by the light receiving unit is equal to or more than the threshold.

In this case, the sensor output detection circuit 705 (FIG. 2) outputs a low-level signal (logic "L") when the amount of light received by the light receiving unit is equal to or more than the threshold. Specifically, while the flag 204 contacts the detected portion 221, the sensor output detection circuit 705 (FIG. 2) outputs the low-level signal (logic "L") to the CPU 701.

Figure 6B:
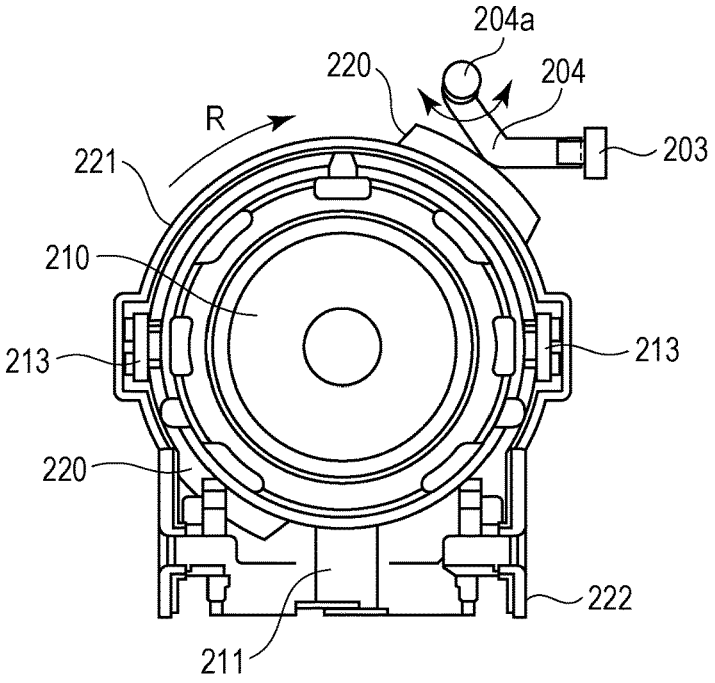

FIG. 6B illustrates a state where the flag 204 contacts the projecting portion 220. In this case, the flag 204 is located between the light emitting unit and the light receiving unit, which makes it difficult for the light receiving unit to receive the light emitted from the light emitting unit. In other words, the amount of light received by the light receiving unit is less than the threshold. The sensor output detection circuit 705 (FIG. 2) outputs a high-level signal (logic "H") when the amount of light received by the light receiving unit is less than the threshold. Specifically, while the flag 204 contacts the projecting portion 220, the sensor output detection circuit 705 (FIG. 2) outputs the high-level signal (logic "H") to the CPU 701.

After the output signal from the sensor output detection circuit 705 (FIG. 2) changes from a high level to a low level, the pump portion 210 of the toner bottle T starts to be expanded. While the output signal from the sensor output detection circuit 705 (FIG. 2) is maintained at the low level, the pump portion 210 starts to be compressed after being fully expanded. After that, before the output signal from the sensor output detection circuit 705 (FIG. 2) changes from the low level to the high level, the pump portion 210 shifts to a state where the pump portion 210 is fully compressed. In other words, while the flag 204 contacts the detected portion 221, the pump portion 210 is expanded and constructed to thereby supply toner to the developing device 100.

(Rotation Speed Control Processing)

The drive motor 604 according to the present exemplary embodiment is a DC motor (DC brush motor). When the drive motor 604 rotationally drives the toner bottle T, the rotation speed of the toner bottle T varies depending on the weight of the toner bottle T. The amount of toner contained in the toner bottle T decreases as toner is supplied from the toner bottle T to the developing device 100, so that the weight of the toner bottle T decreases. If the drive motor 604 causes the toner bottle T to rotate based on a constant PWM value even when the amount of toner contained in the toner bottle T decreases, the rotation speed of the toner bottle T is higher than a target rotation speed.

It is experimentally found that the amount (replenishing amount) of toner to be filled in the developing device 100 from the toner bottle T is a value that is determined depending on the rate of change of the internal pressure of the toner bottle T. Specifically, when the rotation speed of the toner bottle T is higher than the target rotation speed due to a decrease in the weight of the toner bottle T, the replenishing amount of the toner bottle T exceeds a replenishing amount.

Further, according to experiments, as the rotation speed of the toner bottle T increases, the amount of toner to be discharged once from the toner bottle T increases. Specifically, the amount of toner to be discharged when the toner bottle T rotates at a rotation speed of 120 rpm is increased by 40[%] with respect to the amount of toner to be discharged when the toner bottle T rotates at a rotation speed of 30 rpm. In the configuration in which toner is directly filled in the developing device 100 from the toner bottle T, when the amount of toner to be discharged is charged by 40[%], the density of toner on a printed matter may change.

In the present exemplary embodiment, one toner replenishment operation is started from a state where the pump portion 210 is fully compressed, and the pump portion 210 is expanded and then compressed, and the toner replenishment operation is finished in a state where the pump portion 210 is fully compressed. The replenishing amount of toner is affected by the rotation speed when the pump portion 210 is compressed. Accordingly, the position of a rotation start state (i.e., a rotation stop state of the previous toner replenishment) of the toner bottle T according to the present exemplary embodiment is designed so that the DC motor (DC brush motor) is stabilized at a target rotation speed before the pump portion 210 starts to be compressed.

Further, in the present exemplary embodiment, a feedback control of the rotation speed of the toner bottle T reduces a variation in the rotation speed of the toner bottle T according to a change in the weight of the toner bottle T. To accurately perform the feedback control, it is important for the control unit 700 to accurately measure the rotation speed of the toner bottle T.

It takes a long time for the DC motor (DC brush motor) to reach the target rotation speed from the start of the rotation. It also takes a long time for the DC motor (DC brush motor) to stop rotation after the supply of the ENB signal is stopped. Accordingly, there is a need for detecting a timing when the DC motor (DC brush motor) is stabilized at the target rotation speed and measuring the rotation speed. As described above, the DC motor (DC brush motor) according to the present exemplary embodiment is designed so as to be stabilized at the target rotation speed before the pump portion 210 starts to be compressed. Accordingly, the control unit 700 measures the rotation speed of the toner bottle T at the timing when the pump portion 210 performs compression processing.

Rotation speed control processing for the CPU 701 to control rotational driving of the drive motor 604 so that the rotation speed of the drive motor 604 reaches a target speed will be described below with reference to the control block diagram of FIG. 2 and the flowchart of FIG. 7. The rotation speed control processing illustrated in FIG. 7 is executed in such a manner that the CPU 701 illustrated in FIG. 2 reads a program stored in the ROM 702.

Figure 7:
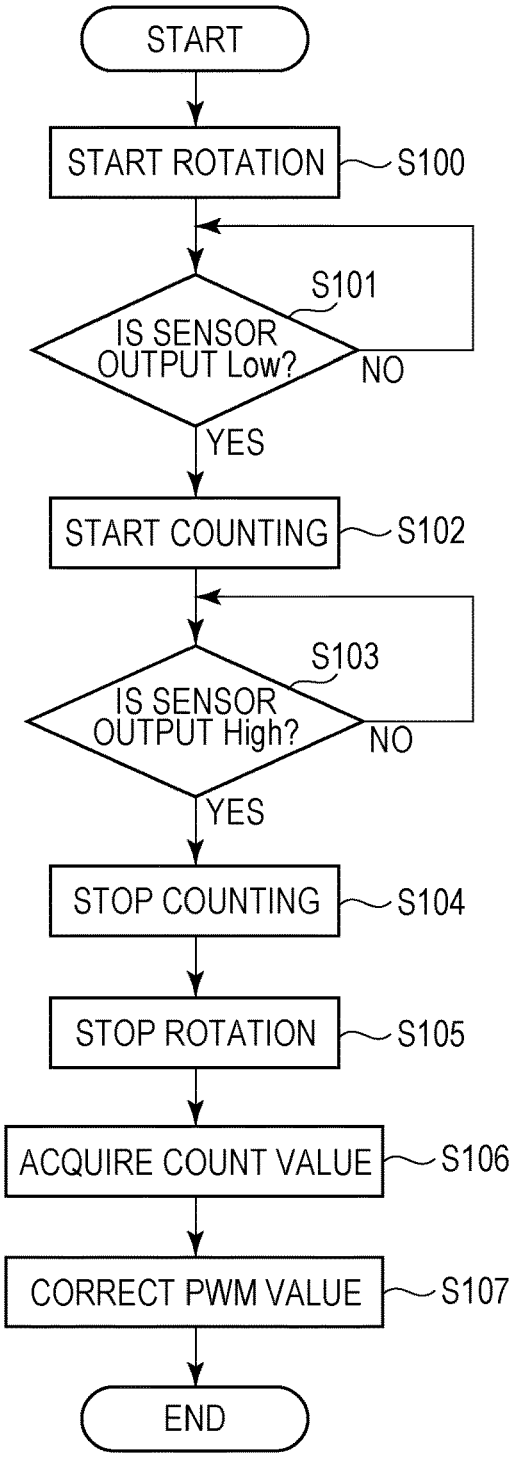
FIG. 7 is a flowchart illustrating rotation speed control processing.

When toner is filled in the developing device 100 from the toner bottle T, the CPU 701 executes the rotation speed control processing illustrated in FIG. 7. Specifically, the CPU 701 executes the rotation speed control processing illustrated in FIG. 7 based on a toner replenishment instruction. The CPU 701 outputs the toner replenishment instruction when the amount of toner contained in the developing device 100 that is detected by the toner density sensor 80 is smaller than a predetermined amount.

First, in step S100, the CPU 701 controls the drive motor 604 to rotate the toner bottle T. In step S100, the CPU 701 sets the PWM value stored in the RAM 703 to the motor drive circuit 704, and outputs the ENB signal to the motor drive circuit 704. This allows the drive motor 604 to start rotating the toner bottle T. If the PWM value is not stored in the RAM 703, the CPU 701 sets, for example, a default value as the PWM value.

After rotational driving of the drive motor 604 is started, the CPU 701 shifts the processing to step S101. In step S101, the CPU 701 stands by until the sensor output detection circuit 705 outputs a low-level signal (logic "L"). In other words, the CPU 701 causes the processing to stand by until the flag 204 contacts the detected portion 221. In step S101, the CPU 701 shifts the processing to step S102 according to the low-level signal output from the sensor output detection circuit 705.

In step S102, the CPU 701 starts counting according to a predetermined clock signal. Next, in step S103, the CPU 701 stands by until the high-level signal (logic "H") is output from the sensor output detection circuit 705. In other words, the CPU 701 stands by until the flag 204 contacts the projecting portion 220. In step S103, the CPU 701 shifts the processing to step S104 according to a change of the signal output from the sensor output detection circuit 705 from the low level to the high level.

In step S104, the CPU 701 stops counting. Specifically, in the process from step S101 to step S104, the CPU 701 measures the time during which the low-level signal is output from the sensor output detection circuit 705. In this case, the period in which the signal output from the sensor output detection circuit 705 is at the low level corresponds to the period in which the flag 204 contacts the detected portion 221 in accordance with the rotation of the toner bottle T. Then, the CPU 701 shifts the processing to step S105.

The CPU 701 determines that the replenishment operation is carried out once (one block) when the output signal from the sensor output detection circuit 705 changes from the low level to the high level. Accordingly, in step S105, the CPU 701 stops rotation of the toner bottle T. The CPU 701 stops the supply of the ENB signal to the motor drive circuit 704, thereby stopping rotational driving of the toner bottle T. Then, the CPU 701 shifts the processing to step S106.

In step S106, the CPU 701 acquires a count value Tn stored in the RAM 703. The count value Tn corresponds to the time when the detected portion 221 is detected by the rotation sensor 203 during the rotation of the toner bottle T. The time when the detected portion 221 is detected by the rotation sensor 203 corresponds to the time when the pump portion 210 is expanded or contracted. This corresponds to the time when the replenishment operation of filling toner in the developing device 100 from the toner bottle T is carried out. The CPU 701 acquires the count value Tn and then shifts the processing to step S107.

In step S107, the CPU 701 corrects the PWM value stored in the RAM 703 based on the count value Tn and terminates the rotation speed control processing. The CPU 701 corrects the PWM value as follows. First, a rotation speed V(n) for the current replenishment operation is obtained from the count value Tn. The count value Tn indicates the time when the flag 204 contacts the detected portion 221. Since the perimeter of the detected portion 221 is known, the rotation speed V(n) for the current replenishment operation is obtained based on the count value Tn.

Next, a corrected value D(n+1) of the PWM set value is calculated based on the following formula.

$$D(n+1)=D(n)+Ki*(Vtgt-V(n))$$

where D(n) represents the current PWM value (i.e., the PWM value set in step S100); Ki represents a predetermined proportionality constant; and Vtgt represents a target rotation speed. The corrected value D(n+1) of the PWM value is used for the subsequent replenishment operation. Specifically, the CPU 701 measures the time when the pump portion 210 is expanded or contracted, and controls the rotational speed for the subsequent rotational driving of the toner bottle T based on the measurement result.

The timing when the flag 204 is pushed up by the projecting portion 220 corresponds to the compression end timing of the pump portion 210. Specifically, the control unit 700 uses the detection result at a front end of the projecting portion 220 in the rotation direction as an index indicating both the end of the measurement time of the rotation speed and the end of the replenishment operation. Thus, the configuration of the projecting portion 220 provided on the drive transmission portion 206 can be simplified and the control of the CPU 701 can also be simplified.

According to the present exemplary embodiment, the CPU 701 corrects the PWM value for controlling the rotation speed of the drive motor 604 based on the time when the detected portion 221 of the toner bottle T is detected by the rotation sensor 203. Thus, the rotation speed of the toner bottle T is controlled to reach the target rotation speed. Accordingly, the amount of toner to be discharged from the toner bottle T can be stabilized.

(Transition of Rotation Speed of Drive Motor)

Figure 8:
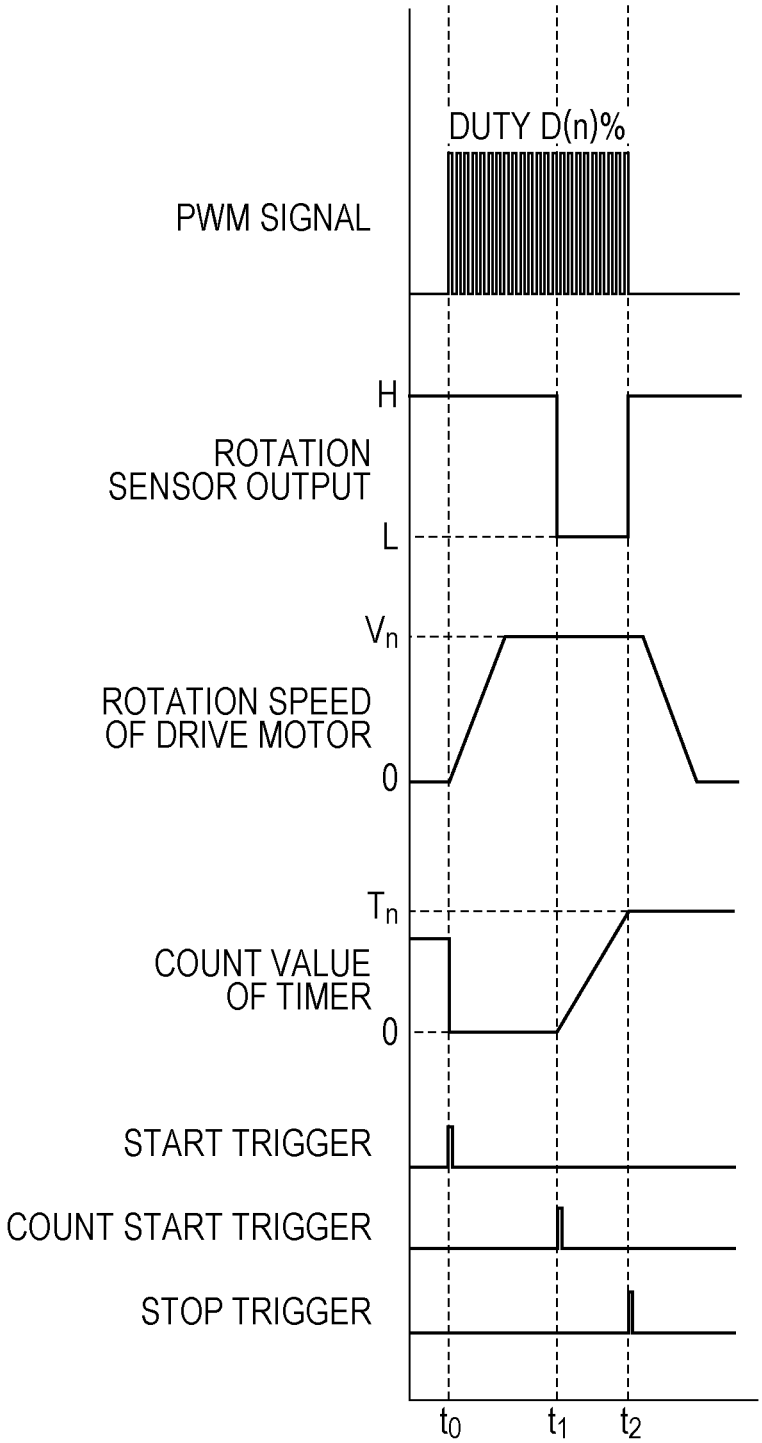
FIG. 8 is a timing diagram illustrating replenishment control.

FIG. 8 is a timing diagram illustrating the PWM value, the output signal from the sensor output detection circuit 705, the rotation speed of the drive motor 604, the count value Tn, a start signal for starting the replenishment operation, a count start signal for starting counting, and a stop signal for terminating the replenishment operation.

When toner is filled in the developing device 100 from the toner bottle T at time t0, the CPU 701 outputs a start signal at time t0. The output of the start signal allows the motor drive circuit 704 to start controlling the time to supply a current to the drive motor 604 based on the PWM value (D(n) [%] illustrated in FIG. 8). Further, the CPU 701 sets the count value to "0" according to the start signal output at time to.

After the motor drive circuit 704 starts rotational driving of the drive motor 604, the rotation speed of the drive motor 604 increases. At this time, the sensor output detection circuit 705 outputs the high-level signal. In other words, the pump portion 210 of the toner bottle T is fully compressed.

Next, at time t1, the output signal from the sensor output detection circuit 705 changes from the high-level signal to the low-level signal. The CPU 701 outputs the count start signal when the output signal from the sensor output detection circuit 705 changes from the high-level signal to the low-level signal. Thus, the count value Tn starts increasing. The pump portion 210 is expanded or contracted while the sensor output detection circuit 705 outputs the low-level signal.

Next, at time t2, the output signal from the sensor output detection circuit 705 changes from the low-level signal to the high-level signal. The CPU 701 outputs a stop signal when the output signal from the sensor output detection circuit 705 changes from the low-level signal to the high-level signal. As a result, the count value Tn stops increasing and the motor drive circuit 704 stops the rotational driving of the drive motor 604. At this time, the pump portion 210 of the toner bottle T is fully compressed. The CPU 701 causes the motor drive circuit 704 to stop rotational driving of the drive motor 604, the pump portion 210 stops rotational driving of the toner bottle T before the pump portion 210 starts to be expanded.

(Replacement Detection Processing)

When the toner bottle T is mounted to the mounting portion 310 at a predetermined rotation angle, the flag 204 is pushed up by the projecting portion 220 (predetermined portion). Specifically, when the user mounts the toner bottle T to the mounting portion 310 at the predetermined rotation angle, the output signal from the rotation sensor 203 changes from the low level to the high level. Accordingly, the CPU 701 determines, based on the output from the rotation sensor 203, whether the toner bottle T is mounted to the mounting portion 310 of the image forming apparatus 200 at the predetermined rotation angle.

Figure 9A:
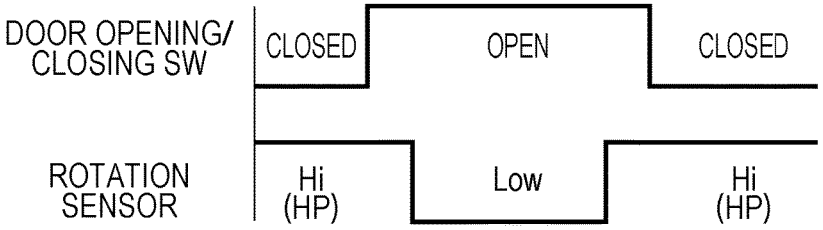
FIGS. 9A and 9B are timing diagrams each illustrating an output signal from a door opening/closing switch (SW) and an output signal from a rotation sensor.
Figure 9B:
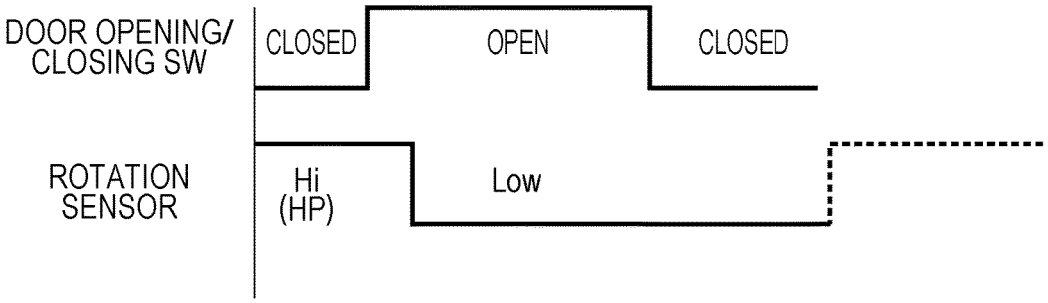

FIGS. 9A and 9B are timing diagrams each illustrating the output timing of each of the output signal from the door opening/closing SW 27 and the output signal from the rotation sensor 203. The operation of determining whether the toner bottle T is mounted to the mounting portion 310 of the image forming apparatus 200 will be described with reference to FIGS. 9A and 9B.

Referring to FIG. 9A, when the toner replenishment operation is not executed, the toner bottle T stops at a home position (HP). At this time, the flag 204 is pushed up by the projecting portion 220 of the toner bottle T. Accordingly, the sensor output detection circuit 705 outputs the high-level signal. If the door 26 is not opened, the door opening/closing SW 27 outputs the low-level signal.

When the user replaces the toner bottle T, the user opens the door 26. When the door 26 is in the open state, the door opening/closing SW 27 outputs the high-level signal. The sensor output detection circuit 705 outputs the low-level output signal when the user removes the toner bottle T from the mounting portion 310. This is because the flag 204 is withdrawn by its own weight from a position between the light emitting unit and the light receiving unit. Since the flag 204 is moved to the position where the optical path is not blocked, the sensor output detection circuit 705 outputs the low-level signal.

After that, the sensor output detection circuit 705 outputs the high-level output signal when the user mounts the toner bottle T to the mounting portion 310. The door opening/closing SW 27 outputs the low-level output signal when the user closes the door 26. While the door opening/closing SW 27 outputs the high-level signal, the output signal from the sensor output detection circuit 705 changes from the high level to the low level. When the output signal changes from the low level to the high level, the CPU 701 determines that the toner bottle T is mounted after being temporarily removed.

However, as illustrated in FIG. 9B, the door 26 may be closed in a state where the sensor output detection circuit 705 outputs the low-level output signal. When the door 26 is closed in a state where the toner bottle T is not mounted to the mounting portion 310, the output signal as illustrated in FIG. 9B is obtained. Alternatively, when the toner bottle T is mounted to the mounting portion 310 and the rotation angle of the toner bottle T is different from a predetermined rotation angle, the output signal as illustrated in FIG. 9B is obtained. In other words, when the door opening/closing SW 27 and the rotation sensor 203 output the output signals as illustrated in FIG. 9B, the CPU 701 cannot determine whether the toner bottle T is mounted to the mounting portion 310.

Accordingly, when the door opening/closing SW 27 and the rotation sensor 203 output the output signals as illustrated in FIG. 9B, the image forming apparatus 200 according to the present exemplary embodiment causes the drive motor 604 to rotate the toner bottle T so as to detect whether the toner bottle T is mounted. When the toner bottle T is mounted to the mounting portion 310, the projecting portion 220 of the rotated toner bottle T is detected by the rotation sensor 203. Specifically, the CPU 701 causes the drive motor 604 to rotate the toner bottle T and determines whether the toner bottle T is mounted to the mounting portion 310 when the output signal from the rotation sensor 203 changes from the low level to the high level.

(Screen Display Control)

FIG. 10 is a schematic diagram illustrating a screen displayed on the liquid crystal screen 707 according to the present exemplary embodiment. FIG. 10A illustrates a warning screen 1 that is displayed on the liquid crystal screen 707 when the toner bottle T in a state where a predetermined amount or more of toner remains in the toner bottle T is removed from the mounting portion 310. On the warning screen 1, information about the color of toner contained in the removed toner bottle T and a message for prompting the user to mount the removed toner bottle T to the mounting portion 310 again are displayed. This prevents the user from erroneously replacing the toner bottle T that needs not be replaced. The warning screen 1 corresponds to a guidance for prompting the user to mount the toner bottle T, which has been removed from the mounting portion 310, again. In the image forming apparatus 200 according to the present exemplary embodiment, when the amount of toner contained in the toner bottle T is less than the predetermined amount, the warning screen 1 is not displayed even if the toner bottle T is removed from the mounting portion 310.

FIG. 10B illustrates a warning screen 2 that is displayed on the liquid crystal screen 707 when the toner bottle T is replaced by another toner bottle T' in a state where the predetermined amount or more of toner remains in the toner bottle. On the warning screen 2, information about the color of toner contained in the toner bottle T that is replaced in the state where the predetermined amount or more of toner remains in the toner bottle, and a message for prompting the user to replace the toner bottle T, which has been previously removed, by the toner bottle T' mounted to the mounting portion 310 are displayed. Thus, it is possible to inform the user that the predetermined amount or more of toner remains in the replaced toner bottle T. Accordingly, waste of toner can be prevented.

After the toner bottle T is mounted to the mounting portion 310, the CPU 701 acquires the identification information of the toner bottle T from the memory 223. The identification information is stored in the RAM 703. The CPU 701 compares the identification information stored in the RAM 703 with the identification of the toner bottle T' that is mounted to the mounting portion 310 after the toner bottle T is removed in the state where the predetermined amount of toner remains in the toner bottle, and detects that the mounting of the other toner bottle T'. If these pieces of identification information are different, the CPU 701 can determine that the toner bottle T is replaced by the other toner bottle T' in the state where the predetermined amount or more of toner remains in the toner bottle.

FIG. 10C illustrates a non-mounted screen that is displayed on the liquid crystal screen 707 when the door 26 is closed in a state where the toner bottle T is not mounted to the mounting portion 310. On the non-mounted screen, a message for prompting the user to mount the toner bottle T to the mounting portion 310 is displayed.

Even in a case where the mounting of the toner bottle T cannot be appropriately detected, there is a need to delete the warning screen 1 that is displayed on the liquid crystal screen 707. If the warning screen 1 is continuously displayed even after the door 26 is closed by the user, the user may feel uncomfortable.

Accordingly, the image forming apparatus 200 according to the present exemplary embodiment has a configuration in which the warning screen 1 can be hidden also when the output signal from the door opening/closing SW changes from the high level to the low level. With this configuration, the warning screen 1 can be deleted when the user closes the door 26, even if the rotation sensor 203 cannot detect the projecting portion 220 in a state where the toner bottle T is mounted to the mounting portion 310.

A screen display control for the liquid crystal screen 707 will be described with reference to the control block diagram of FIG. 2 and the flowchart of FIG. 11. The screen display control illustrated in FIG. 11 is executed in such a manner that the CPU 701 illustrated in FIG. 2 reads a program stored in the ROM 702. After the main power source of the image forming apparatus 200 is turned on, the CPU 701 acquires the replenishment information of the toner bottle T mounted to the mounting portion 310 by using the reading unit 224. The replenishment information includes, for example, the color of toner contained in the toner bottle T, the identification number of the toner bottle T, and the replenishment history of the toner bottle T. The CPU 701 stores the replenishment information in the RAM 703.

When the amount of toner contained in the toner bottle T is equal to or more than the predetermined amount and the opening/closing detection signal from the door opening/closing SW 27 changes from the low level to the high level, the CPU 701 starts the screen display control. The CPU 701 determines, for example, whether the amount of toner contained in the toner bottle T is equal to or more than the predetermined amount based on the number of rotations of the toner bottle T. Specifically, when the number of rotations of the toner bottle T is less than a predetermined number, the CPU 701 determines that the amount of toner contained in the toner bottle T is equal to or more than the predetermined amount.

The amount of toner to be discharged from the toner bottle T according to the present exemplary embodiment in one replenishment operation is determined. Accordingly, the remaining amount of toner contained in the toner bottle T can be determined based on the number of rotations of the toner bottle T. The CPU 701 determines whether the toner bottle T mounted to the mounting portion 310 satisfies a replacement condition. For example, when the number of rotations of the toner bottle T is equal to or greater than the predetermined number, the CPU 701 determines that the replacement condition is satisfied. Accordingly, when the number of rotations of the toner bottle T is less than the predetermined number, the CPU 701 determines that the replacement condition is not satisfied.

In step S200, the CPU 701 determines whether the toner bottle T is removed. In step S200, when the output signal from the sensor output detection circuit 705 changes from the high level to the low level in a state where the drive motor 604 is stopped, the CPU 701 determines that the toner bottle T is removed. In step S200, when the output signal from the sensor output detection circuit 705 changes from the high level to the low level, the CPU 701 shifts the processing to step S201. When the door 26 is closed without removing the toner bottle T, the CPU 701 terminates the screen display control.

In step S201, the CPU 701 displays the warning screen 1 on the liquid crystal screen 707. Specifically, when the amount of toner contained in the toner bottle T is equal to or more than the predetermined amount and the toner bottle T is removed, the CPU 701 displays the warning screen 1 on the liquid crystal screen 707. Then, the CPU 701 shifts the processing to step S202.

In step S202, it is determined whether the toner bottle T is mounted to the mounting portion 310. In step S202, the CPU 701 determines that the toner bottle T is mounted when the output signal from the sensor output detection circuit 705 is changed from the low level to the high level. When the toner bottle T is mounted, the CPU 701 shifts the processing to step S204.

On the other hand, in step S202, when the output signal from the sensor output detection circuit 705 is maintained at the low level, the CPU 701 shifts the processing to step S203. In step S203, the CPU 701 determines whether the door 26 is closed. When the opening/closing detection signal from the door opening/closing SW 27 changes from the high level to the low level, the CPU 701 determines that the door 26 is closed. In step S203, when the opening/closing detection signal from the door opening/closing SW 27 changes from the high level to the low level, the CPU 701 shifts the processing to step S210.

On the other hand, in step S203, when the opening/closing detection signal is maintained at the high level, the CPU 701 shifts the processing to step S202. Specifically, the CPU 701 repeatedly executes the processing from step S202 to step S203 until the toner bottle T is mounted to the mounting portion 310, or until the door 26 is closed.

In step S204, the CPU 701 deletes the warning screen 1 displayed on the liquid crystal screen 707. In other words, the warning screen 1 is hidden. If the mounting of the toner bottle T is detected, the CPU 701 hides the warning screen 1 even if the door 26 is in the open state. In step S204, the CPU 701 may display another screen, which is different from the warning screen 1, on the liquid crystal screen 707. Then, the CPU 701 shifts the processing to step S205.

In step S205, the CPU 701 reads the replenishment information from the memory 223 of the mounted toner bottle T by using the reading unit 224. The replenishment information includes the identification information. The CPU 701 shifts the processing to step S206 to carry out identification processing.

In step S206, the CPU 701 determines whether the toner bottle T mounted to the mounting portion 310 is identical to the toner bottle T that has been previously removed. The CPU 701 determines whether the identification information read in step S205 is identical to the identification information stored in the RAM 703.

In step S206, when these pieces of identification information are different, the CPU 701 shifts the processing to step S207. In step S207, the CPU 701 displays the warning screen 2 on the liquid crystal screen 707. Even if the door 26 is in the open state, the CPU 701 displays the warning screen 2 on the liquid crystal screen 707 when the pieces of identification information are different. After the warning screen 1 is deleted, the warning screen 2 corresponds to a guidance to be displayed when the toner bottle T mounted to the mounting portion 310 is different from the toner bottle T that has been previously mounted. Then, the CPU 701 shifts the processing to step S208.

In step S206, if the pieces of identification information are identical, the CPU 701 shifts the processing to step S208. In other words, if the pieces of identification information are identical, the CPU 701 shifts the processing to step S208 without displaying the warning screen 2.

In step S208, the CPU 701 determines whether the door 26 is closed. When the opening/closing detection signal from the door opening/closing SW 27 changes from the high level to the low level, the CPU 701 determines that the door 26 is closed. When the opening/closing detection signal changes from the high level to the low level, the CPU 701 terminates the screen display control.

On the other hand, when the opening/closing detection signal is maintained at the high level, the CPU 701 shifts the processing to step S209. In step S209, the CPU 701 determines whether the toner bottle T is removed. When the output signal from the sensor output detection circuit 705 changes from the high level to the low level, the CPU 701 determines that the toner bottle T is removed. When the output signal from the sensor output detection circuit 705 changes from the high level to the low level, the CPU 701 shifts the processing to step S201. Specifically, the warning screen 1 is displayed again on the liquid crystal screen 707 when the toner bottle T mounted to the mounting portion 310 is removed without closing the door 26 after the warning screen 1 is deleted.

Further, in step S209, when the output signal from the sensor output detection circuit 705 is maintained at the high level, the CPU 701 shifts the processing to step S208. Specifically, the CPU 701 repeatedly executes the processing of step S208 and step S209 until the toner bottle T is removed, or until the door 26 is closed.

In step S210, the CPU 701 deletes the warning screen 1 displayed on the liquid crystal screen 707. In other words, the warning screen 1 is hidden. When the door 26 is closed without detecting the mounting of the toner bottle T, the CPU 701 hides the warning screen 1. In step S210, the CPU 701 may display another screen, which is different from the warning screen 1, on the liquid crystal screen 707. Then, the CPU 701 shifts the processing to step S211.

In step S211, the CPU 701 executes a bottle presence/absence detection which is described below. The bottle presence/absence detection is processing for determining whether the toner bottle T is mounted to the mounting portion 310. After the bottle presence/absence detection is executed, the CPU 701 shifts the processing to step S212.

In step S212, the CPU 701 determines whether the toner bottle T is mounted to the mounting portion 310 based on the result of the bottle presence/absence detection. In step S211, when it is determined that the toner bottle T is mounted to the mounting portion 310, the CPU 701 shifts the processing to step S213.

In step S213, the CPU 701 reads the replenishment information from the memory 223 of the mounted toner bottle T by using the reading unit 224. The replenishment information includes identification information. Then, the CPU 701 shifts the processing to step S214 to carry out the identification processing.

In step S214, when the pieces of identification information are different, the CPU 701 shifts the processing to step S215. In step S215, the CPU 701 displays the warning screen 2 on the liquid crystal screen 707. Then, the CPU 701 terminates the screen display control. The image forming apparatus 200 according to the present exemplary embodiment terminates the screen display control in a state where the warning screen 2 is displayed. When the user opens the door 26, the CPU 701 executes the screen display control again from step S200.

On the other hand, in step S214, when the pieces of identification information are identical, the CPU 701 determines that the toner bottle T, which has been previously removed, is mounted again, and terminates the screen display control.

Further, in step S212, when the toner bottle T is not mounted, the CPU 701 shifts the processing to step S216. In step S216, the CPU 701 displays the non-mounted screen on the liquid crystal screen 707. Specifically, when the door 26 is closed without mounting the toner bottle T to the mounting portion 310, the non-mounted screen is displayed on the liquid crystal screen 707. Then, the CPU 701 terminates the screen display control while the non-mounted screen is displayed on the liquid crystal screen 707. The image forming apparatus 200 according to the present exemplary embodiment terminates the screen display control in a state where the non-mounted screen is displayed. When the user opens the door 26, the CPU 701 executes the screen display control again from step S200. In step S216, the non-mounted screen displayed on the liquid crystal screen 707 may be commonly used as the warning screen 1 illustrated in FIG. 10A.

(Bottle Presence/Absence Detection)

Figure 12:
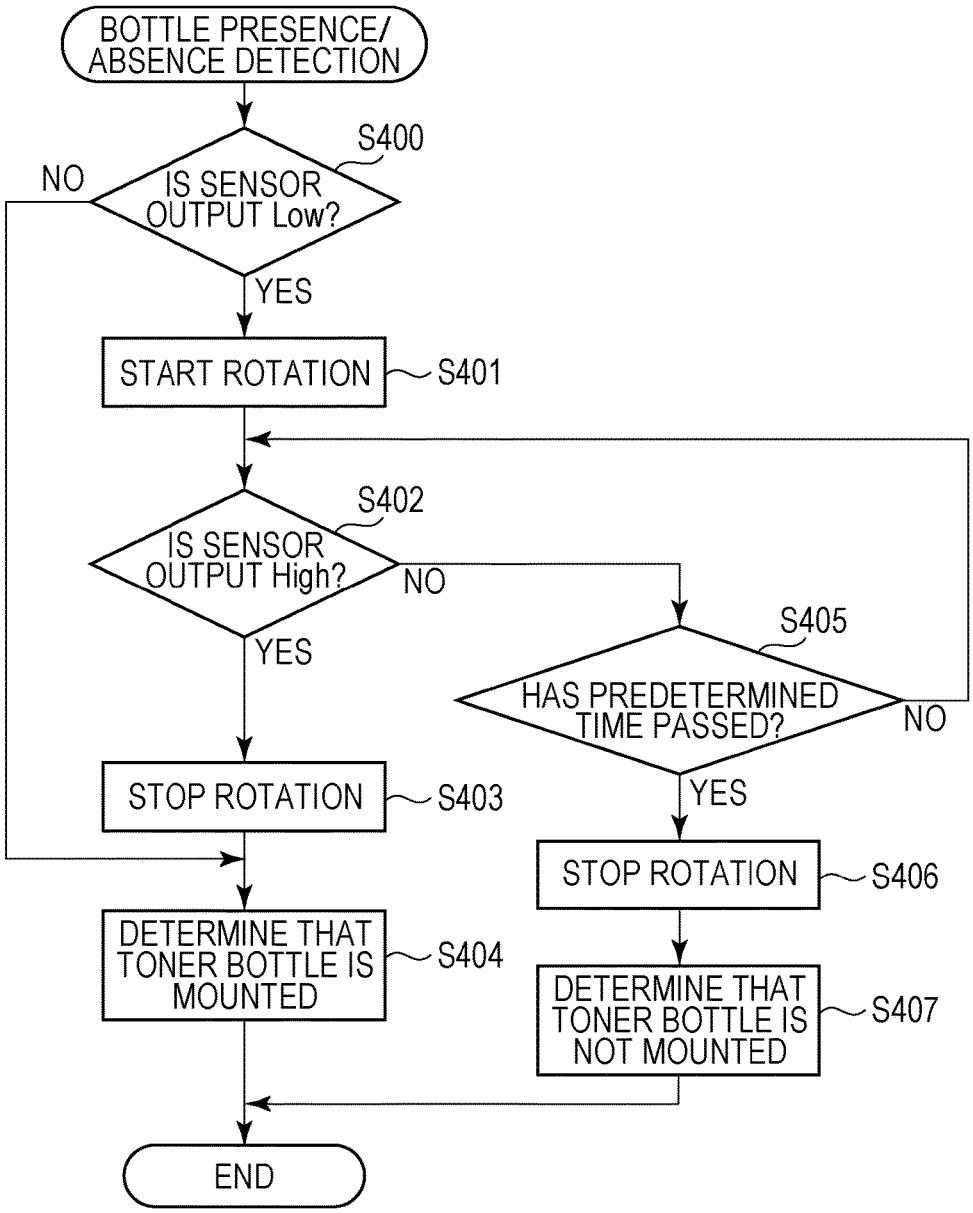
FIG. 12 is a flowchart illustrating bottle presence/absence detection.

Next, the bottle presence/absence detection executed in step S211 illustrated in FIG. 11 will be described with reference to the control block diagram of FIG. 2 and the flowchart of FIG. 12. The bottle presence/absence detection illustrated in FIG. 12 is a control for determining whether the toner bottle T is mounted to the mounting portion 310 when the toner bottle T is not detected by the sensor output detection circuit 705 and the door 26 is closed. The bottle presence/absence detection illustrated in FIG. 12 is executed in such a manner that the CPU 701 reads a program stored in the ROM 702.

After the execution of the bottle presence/absence detection, the CPU 701 shifts the processing to step S400. In step S400, the CPU 701 determines whether the output signal from the sensor output detection circuit 705 is at the low level. When the toner bottle T is mounted to the mounting portion 310 at the predetermined rotation angle, the sensor output detection circuit 705 outputs the high-level output signal. In other words, when the toner bottle T is mounted to the mounting portion 310 at a rotation angle different from the predetermined rotation angle, the sensor output detection circuit 705 outputs the high-level output signal. When the toner bottle T is not mounted to the mounting portion 310, the sensor output detection circuit 705 outputs the high-level signal.

When the output signal from the sensor output detection circuit 705 is at the low level, the CPU 701 shifts the processing to step S401. In step S401, the CPU 701 drives the drive motor 604. In step S401, the CPU 701 sets the PWM value stored in the RAM 703 to the motor drive circuit 704 and outputs the ENB signal to the motor drive circuit 704. This allows the drive motor 604 to be driven. After the drive motor 604 starts driving, the CPU 701 starts measuring the time using a timer which is not illustrated.

After the drive motor 604 starts driving, the CPU 701 shifts the processing to step S402. In step S402, the CPU 701 determines whether the output signal from the sensor output detection circuit 705 is at the high level. When the toner bottle T is mounted to the mounting portion 310, the toner bottle T is rotated, and thus the projecting portion 220 of the toner bottle T is detected by the rotation sensor 203. Specifically, when the toner bottle T is mounted to the mounting portion 310, the output signal from the sensor output detection circuit 705 changes from the low level to the high level after the drive motor 604 is driven.

In step S402, when the output signal from the sensor output detection circuit 705 is at the high level, the CPU 701 shifts the processing to step S403. Specifically, when the output signal from the sensor output detection circuit 705 changes from the low level to the high level, the CPU 701 stops driving the drive motor 604. The CPU 701 stops supplying the ENB signal to thereby stop driving the drive motor 604. When the drive motor 604 stops driving, the CPU 701 stops measuring the time by the timer. Then, the CPU 701 shifts the processing to step S404.

In step S404, the CPU 701 detects that the toner bottle T is mounted to the mounting portion 310 and terminates the bottle presence/absence detection processing. Then, the CPU 701 shifts the processing to step S212 of the screen display control illustrated in FIG. 11.

In step S400, when the output signal from the sensor output detection circuit 705 is at the high level, the CPU 701 shifts the processing to step S404. In this case, since the rotation sensor 203 detects the projecting portion 220, the CPU 701 determines that the toner bottle T is mounted to the mounting portion 310 in step S404.

In step S402, when the output signal from the sensor output detection circuit 705 is at the low level, the CPU 701 shifts the processing to step S405 to determine whether the driving time of the drive motor 604 has reached a predetermined time. In step S405, the CPU 701 determines whether a predetermined time has passed after driving of the drive motor 604 is started in step S401 based on the measurement result of the timer (not illustrated).

The predetermined time described herein refers to a time long enough for the rotation sensor 203 to detect the projecting portion 220 after the rotation of the drive motor 604 is started. If the rotation sensor 203 cannot detect the projecting portion 220 within the predetermined time after the drive motor 604 is driven, the CPU 701 determines that the toner bottle T is not mounted to the mounting portion 310.

In step S405, when the driving time of the drive motor 604 is less than the predetermined time, the CPU 701 shifts the processing to step S402. Specifically, the CPU 701 continuously drives the drive motor 604 until the high-level output signal is output from the sensor output detection circuit 705, or until the predetermined time has passed. When the driving time has reached the predetermined time, the CPU 701 shifts the processing to step S406.

In step S406, the CPU 701 stops driving the drive motor 604. The CPU 701 stops supplying the ENB signal to thereby stop driving the drive motor 604. When the drive motor 604 stops driving, the CPU 701 stops measuring the time by the timer. Then, the CPU 701 shifts the processing to step S407.

In step S407, the CPU 701 determines that the toner bottle T is not mounted to the mounting portion 310. Then, the CPU 701 terminates the bottle presence/absence detection processing and shifts the processing to step S212 of the screen display control illustrated in FIG. 11.

According to the bottle presence/absence detection described above, it is possible to determine whether the toner bottle T is mounted to the mounting portion 310 even when the projecting portion 220 of the toner bottle T is not detected by the rotation sensor 203 in the state where the door 26 is closed.

The liquid crystal screen 707 according to the present exemplary embodiment hides the warning screen 1 for prompting the user to mount the toner bottle T when the projecting portion 220 of the toner bottle T is detected by the rotation sensor 203, or when closing of the door 26 is detected by the door opening/closing SW 27. Thus, the warning screen 1 can be rapidly deleted when the door 26 is closed, even if the toner bottle T is mounted to the mounting portion 310 at a rotation angle different from the predetermined rotation angle. Therefore, the warning screen 1 is prevented from being continuously displayed even after the user closes the door 26. In addition, it is possible to prevent the user from repeatedly mounting and detaching the toner bottle T, and it is also possible to prevent occurrence of downtime in the image forming apparatus 200.

Further, the image forming apparatus 200 according to the present exemplary embodiment has a configuration including the operation unit 706 including the liquid crystal screen 707. However, the image forming apparatus 200 may have a configuration in which the warning screen 1 is displayed on a monitor of an external apparatus connected to the image forming apparatus 200, instead of displaying the warning screen 1 on the liquid crystal screen 707.

Furthermore, the CPU 701 according to the present exemplary embodiment determines that the replacement condition is not satisfied when the number of rotations of the toner bottle T is less than the predetermined number. However, the replacement condition is not limited to the number of rotations of the toner bottle T. For example, the CPU 701 may determine that the replacement condition is satisfied when the amount of toner contained in the developing device 100 is not equal to or more than the predetermined amount even if the toner bottle T is rotated.

According to the present invention, it is possible to prevent the warning screen from being continuously displayed even after the container is mounted to the mounting portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-081520, filed Apr. 17, 2017, which is hereby incorporated by reference herein in its entirety.

What is claimed is:

1. An image forming apparatus comprising:

an image forming unit configured to form an image by using a developer;

a mounting unit to which a container is mounted, wherein the container is configured to contain a developer, and wherein the container supplies the developer to the image forming unit;

a cover configured to be opened to replace the container mounted to the mounting unit, and to be closed to cover the container mounted to the mounting unit;

a detector configured to detect the container mounted to the mounting unit, the detector being capable of detecting the container mounted to the mounting unit in a state where the cover is closed or in a state where the cover is opened;

a controller configured to determine whether a remaining amount of the developer contained in the container mounted to the mounting unit is more than a predetermined amount; and a display unit configured to:

display, in a case where the container in which the remaining amount of developer is more than the predetermined amount is removed from the mounting unit, a first screen to prompt re-mounting of the removed container, display a second screen different from the first screen in a case where the cover is closed without detecting the container by the detector after the first screen is displayed, and display a third screen different from the second screen after the second screen is displayed in a case where the container is not mounted to the mounting unit.

2. The image forming apparatus according to claim 1, wherein the display unit hides the first screen in a case where the cover is closed without detecting the container by the detector after the first screen is displayed.

3. The image forming apparatus according to claim 1, wherein after the second screen is displayed by the display unit, the detector detects whether a container is mounted to the mounting unit in a closed state of the cover, and the display unit displays the third screen in a case where the mounting of the container to the mounting unit in the closed state of the cover is not detected by the detector.

4. The image forming apparatus according to according to claim 1, wherein after the second screen is displayed by the display unit, the detector detects whether a container is mounted to the mounting unit in a closed state of the cover, and in a case where the mounting of the container to the mounting unit in the closed state of the cover is not detected by the detector, the display unit continuously displays the second screen without displaying the third screen.

5. The image forming apparatus according to claim 1, wherein the first screen is hidden before the cover is closed in a case where the container is detected by the detector after the first screen is displayed.

6. The image forming apparatus according to claim 1, wherein the second screen is displayed before the cover is closed in a case where the container is detected by the detector after the first screen is displayed.

7. The image forming apparatus according to claim 1, wherein the first screen and the third screen are commonly used.

8. The image forming apparatus according to claim 1, wherein in a case where another container different from the removed container is mounted to the mounting unit, the display unit displays a fourth screen for prompting re-mounting of the removed container.

9. The image forming apparatus according to claim 1, wherein in a case where another container different from the removed container is mounted to the mounting unit, the display unit displays a fourth screen for notifying that the container mounted to the mounting unit is another container different from the removed container.

10. The image forming apparatus according to claim 1, further comprising a motor configured to drive the container mounted to the mounting unit to rotate, wherein the detector detects a predetermined portion in a rotation direction of the container mounted to the mounting unit.

11. The image forming apparatus according to claim 10, wherein the controller controls, based on a detection result of the detector, the motor to control a rotation speed of the mounted container.

12. The image forming apparatus according to claim 10, wherein the controller controls the motor to stop the rotation of the mounted container in a state where the predetermined portion is detected by the detector.

13. The image forming apparatus according to claim 10, wherein after the first screen is displayed, the controller drives the motor for a predetermined time in a case where the container is not detected by the detector and the cover is closed, the detector detects whether the container is mounted to the mounting unit at the predetermined time, and the display unit displays the third screen in a case where the container is not detected by the detector at the predetermined time.

14. The image forming apparatus according to claim 1, wherein the controller determines whether the remaining amount is more than the predetermined amount based on the number of rotations of the container mounted to the mounting unit.

15. The image forming apparatus according to claim 1, wherein the controller determines that the remaining amount is more than the predetermined amount in a case where the number of rotations of the container mounted to the mounting unit is less than a predetermined number.

* * * * *